US009068734B2

(12) United States Patent
Harris

(10) Patent No.: US 9,068,734 B2
(45) Date of Patent: Jun. 30, 2015

(54) SOUND ADAPTIVE COOLING SYSTEM FOR A STAGE LIGHT

(71) Applicant: Jeremiah J. Harris, New Windsor, NY (US)

(72) Inventor: Jeremiah J. Harris, New Windsor, NY (US)

(73) Assignee: Production Resource Group, LLC, New Windsor, NY (US)

( * ) Notice: Subject to any disclaimer, the term of this patent is extended or adjusted under 35 U.S.C. 154(b) by 0 days.

(21) Appl. No.: 14/265,648

(22) Filed: Apr. 30, 2014

(65) Prior Publication Data

US 2014/0232269 A1 Aug. 21, 2014

Related U.S. Application Data

(63) Continuation of application No. 12/896,028, filed on Oct. 1, 2010, now Pat. No. 8,716,940.

(60) Provisional application No. 61/247,927, filed on Oct. 1, 2009.

(51) Int. Cl.

| | |
|---|---|
| ***H05B 37/02*** | (2006.01) |
| ***F21V 29/02*** | (2006.01) |
| ***F21V 23/04*** | (2006.01) |
| ***F21V 29/67*** | (2015.01) |
| *F21W 131/406* | (2006.01) |

(52) U.S. Cl.

CPC ..... *F21V 29/025* (2013.01); *F21V 23/0442* (2013.01); *F21V 29/02* (2013.01); *F21W 2131/406* (2013.01); *F21V 29/673* (2015.01)

(58) Field of Classification Search

USPC ..... 315/112, 117, 291, 307, 308; 362/218, 362/264, 294, 373, 580

See application file for complete search history.

(56) References Cited

U.S. PATENT DOCUMENTS

| | | | | |
|---|---|---|---|---|
| 6,360,185 | B1 * | 3/2002 | Futawatari | 702/182 |
| 6,809,780 | B2 | 10/2004 | Sawai et al. | |
| 7,606,640 | B2 * | 10/2009 | Hirai et al. | 700/300 |
| 7,974,714 | B2 | 7/2011 | Hoffberg | |
| 8,232,745 | B2 | 7/2012 | Chemel et al. | |
| 8,716,940 | B2 * | 5/2014 | Harris | 315/112 |
| 2006/0236845 | A1 | 10/2006 | Kilkis | |
| 2006/0262544 | A1 | 11/2006 | Piepgras et al. | |
| 2010/0245279 | A1 | 9/2010 | Kubis et al. | |

FOREIGN PATENT DOCUMENTS

| | | |
|---|---|---|
| EP | 2622263 | 8/2013 |
| WO | WO2005084339 | 9/2005 |

* cited by examiner

*Primary Examiner* — Jimmy Vu

(74) *Attorney, Agent, or Firm* — Law Office of Scott C. Harris, Inc.

(57) ABSTRACT

A sound adapting luminaire produces an amount of cooling output that depends on the ambient sound. When the ambient sound is high, the lamp is cooled more aggressively, since more fan noise is acceptable.

17 Claims, 2 Drawing Sheets

SOUND ADAPTIVE COOLING SYSTEM FOR A STAGE LIGHT

This is a continuation of application Ser. No. 12/896,028, filed Oct. 1, 2010, the entire contents of which are herewith incorporated by reference.

This application claims priority from provisional application No. 61/247,927, filed Oct. 1, 2009, the entire contents of which are herewith Incorporated by reference.

BACKGROUND

Stage lights are often used in entertainment venues.

Stage lights use very high intensity bulbs, for example 500 to 1500 W, and also have electronics therein to control their effects. All of this is housed within the housing. Cooling of the inside and/or outside often becomes necessary to avoid overheating within the housing. Many such lights use a fan for the cooling.

SUMMARY

The present inventor recognized that sometimes the sound of a fan can interfere with the show that is being lit by the light. However, other times the sound of the fan will not interfere with the show. Often, whether the fan will interfere or not interfere depends on the ambient sound during the show.

DETAILED DESCRIPTION

The inventor recognized that stage lights are often produced with minimized sound output to avoid them being noticeable during a quiet part of a show. The maximum output of the stage light needs to be low enough that it will not interfere with the quietest part of any show.

However the inventor recognized that there are some times during the show where the sound is loud, and noise from the fan will not be heard over those loud portions of the show. At these portions, the amount of sound created by the fan would not actually interfere.

For example, while the orchestra is playing at full blast, full fan output from the lights will not be heard by anyone. However, during quiet times of the show, the full fan output might be heard and might actually be a distraction.

When lights are designed with minimal fan noise output, there is often a trade-off between that noise output, and the amount of cooling the fan can do. For example, one way of reducing the noise from the fan is to reduce the speed of the fan, since fans running slower are often quieter. Another way of reducing the noise is to put sound blocking material over the openings, but this can reduce the airflow of the fan.

In order to address this problem, an embodiment describes a smart fan, where the fan is run more aggressively when the ambient sound increases, and less aggressively when the ambient sound decreases. The fan can be a variable speed fan whose speed is controlled by an external input. For example, in one embodiment, the output from the processor to the fan can be a variable voltage, and the fan can operate based on that variable voltage. In another embodiment, the fan can be a digital fan whose speed is controlled by a digital input received from the processor.

In an embodiment, the fan may be turned off entirely when the ambient sound is less than a specified amount.

Figure 1:
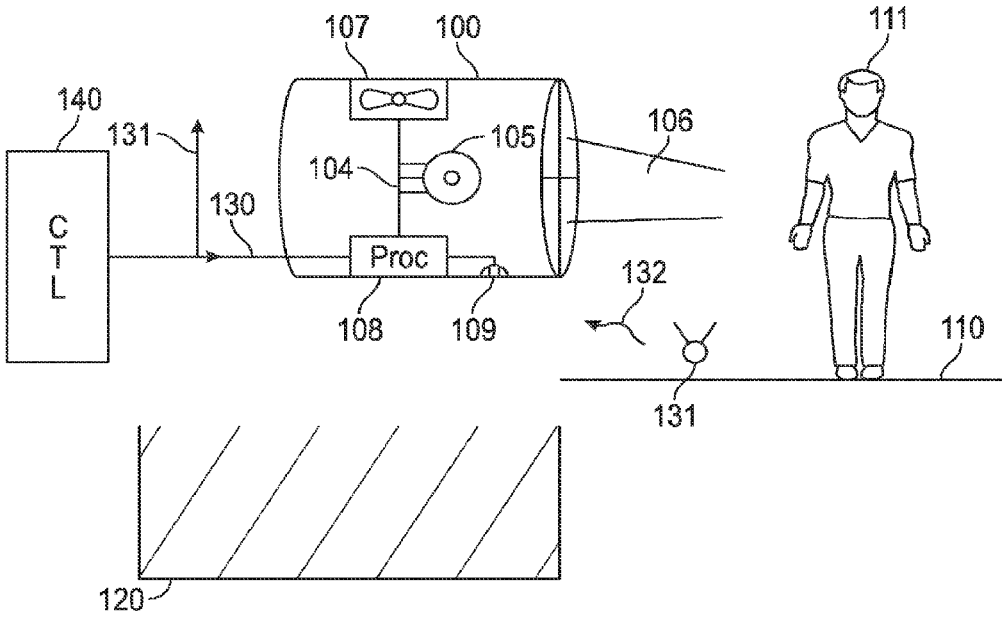
FIG. 1 shows stage lights being used in a show environment.

FIG. 1 shows a luminaire 100, in a stage environment, where there is a stage 110, and one or more actors 111. The audience area 120 is shown directly under the luminaire 100. The luminaire 100 is remotely controlled over a line 130 from a controller 140. The controller may send, and the luminaire may receive, commands for various controls of the lamp including pointing direction of the luminaire, and brightness of the lamp 105. The one controller 140 may control multiple lights over the same line 130, with the line portion 131 representing other lights that can be controlled by the same or over the same line. In one embodiment, the controller 140 is a lighting control console.

The luminaire 100 includes a number of parts, including a lamp 105 that emits light. In one embodiment, the lamp is within a socket 104, and the lamp can be inserted into the socket or removed from the socket. The light rays are shown as 106 going towards the performer on the stage out the front portion of the luminaire. The light rays can be, for example, projected by a projection lamp, or can be emitted light which is from a light emitting source such as a light emitting diode. The luminaire also includes a fan 107 which is controlled by a processing element 108.

The processing element 108 may also receive commands over the line 130. A microphone 109 receives ambient sound, and produces an output indicative of that ambient sound to the processor 108.

In another embodiment, the signals received by the processor 130 may include information indicative of the amount of ambient sound. For example, these signals may include a signal from the controller 140 that indicates an amount of the ambient sound, since this value is typically staged and hence known in advance. In another embodiment, the signals 130 may include a wirelessly-received signal from a microphone 131, for example, placed on the stage. For example, there may be a microphone shown as 131 that produces a wireless output 132 that is sent to a number of the different luminaire such as 100. In another embodiment, the microphone 131 may be wired and connected to the controller 140, so that the value indicative of the sound comes from the controller over the wired line 130.

The processor 108 controls the speed of the fan 107, and hence the amount of sound that the fan produces. For example, when the fan is off, the fan presumably produces no sound at all. Turning the fan on more aggressively causes the fan to produce more sound. The output from the processor to the fan includes information that indicates to the fan the amount of cooling that the fan should carry out. For example, this information may include a digital signal indicative of the speed of the fan, or the on off condition of the fan. Alternatively, the output of the processor to the fan could be a driving voltage to the fan, whose voltage varies to change the amount of output of the fan.

FIG. 1 shows the embodiment where the output of the processor 108 is directly connected to the fan, that is the fan receives a digital input.

Figure 2:
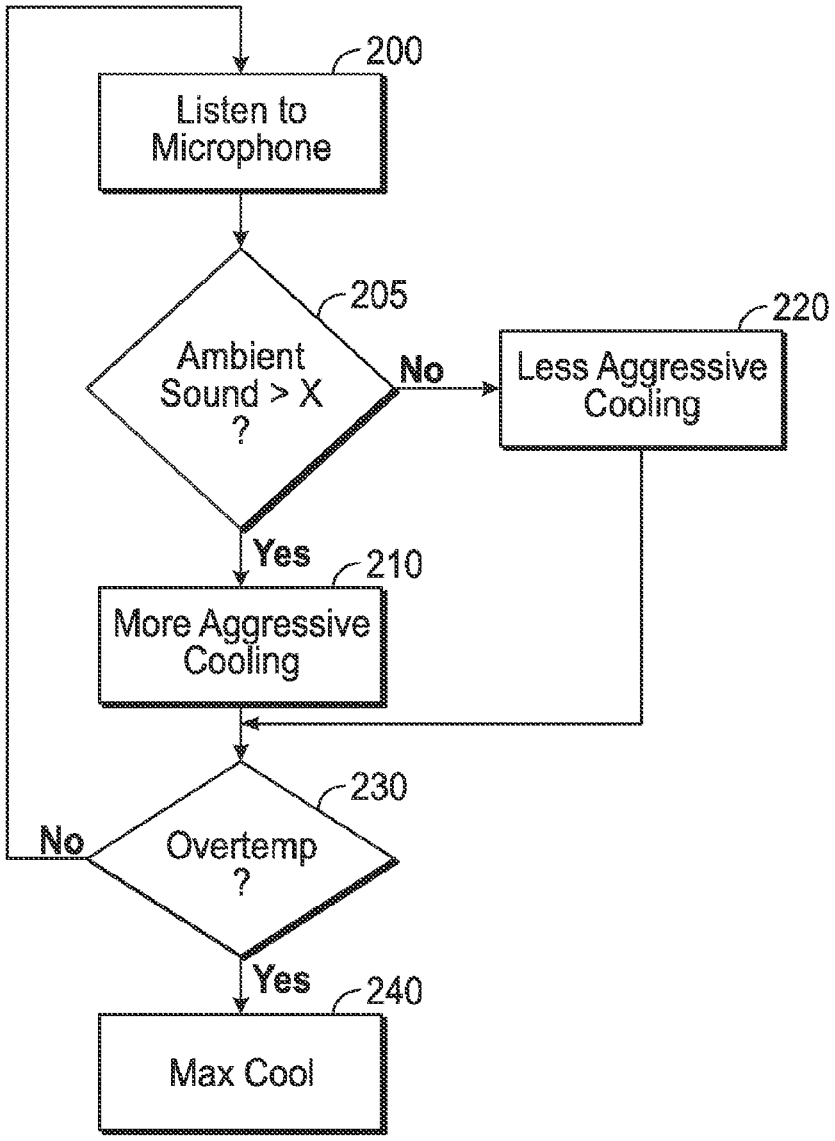
FIG. 2 shows an exemplary flowchart of operation of the stage light as used in the show environment.
Figure 3:
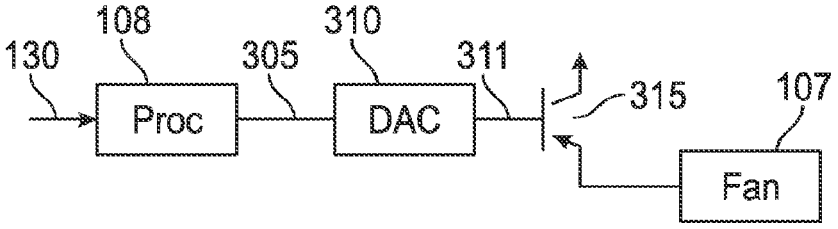
FIG. 3 shows an alternative fan operating embodiment.

FIG. 2 shows an alternative embodiment in which the fan receives an analog input. In FIG. 2, the processor output 305 is a digital output. This output is converted by a D/A converter 310 to an analog signal 311 indicative of the desired output value. For example, for 12 V fan, the output value 311 may be between zero and 12 V. For a higher voltage fan, the output value may be a higher voltage output. A voltage amplifier may also be used to scale up the output voltage 311. The output voltage 311 is buffered by a follower 315, and connected to the fan 107. In this way, the output of an analog fan is controlled by the digital output from the processor.

The operation of the processor 108 may be produced according to the flowchart shown in FIG. 2. At 200, the processor obtains an output from the microphone 109. The output from the microphone 109 is indicative of the amount of sound that is occurring in the area of the luminaire at any given time.

At 205, the processor determines if the ambient sound is greater than a value x. The value x may be for example set to the amount of sound that the fan will produce during its normal "aggressive" operation. In one embodiment, the microphone 109 may include structure embedded therein which produces a signal only when the sound is greater than x. In this case, the steps 200, 205 may be carried out by that hardware instead of by the processor.

When the ambient sound is greater than x, that is during a loud part of the show, then more aggressive cooling is carried out at 210. The more aggressive cooling may be maximum fan speed, for example, in one embodiment. In another embodiment, the aggressive operation may be normal fan speed.

When the ambient sound is less than x, at 205, this means that there should be less aggressive cooling at 220. The less aggressive cooling may be the fan on the lowest speed, or may be the fan entirely off. In any case, this less aggressive cooling causes less cooling, but does so only when the ambient sound indicates that this is a quiet portion of the show.

The above has described only two different modes of cooling: less aggressive and more aggressive cooling. Another embodiment may divide the cooling among a number of different speed modes. For example, if there may be five fan modes, each of which has a rated sound output. Sound output number 1 from the fan may be a sound output that will not be hearable or noticeable so long as the ambient sound is less than a first value X1. For example, a first fan mode may produce 24 DB of sound from the fan, during the quietest part of the performance. During a time when the performance sound is low, the fan may produce 27 DB of sound. During the time when the performance sound is highest, the fan may produce 40 DB of sound. More sound translates to more aggressive cooling by the fan.

230 determines whether there is an over temperature condition in the lamp housing. When there is an overtemperature condition at 230, this indicates an emergency. For example, in the less aggressive cooling scenario, an overtemperature may occur because no cooling or insufficient cooling has occurred. In an embodiment, the overtemperature at 230, forces maximum cooling at 240. This will cause more sound than might be desired, however prevents the lamp and the luminaire from being harmed by overtemperature.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example, other lights and controls can be used. Any kind of fan can be controlled by the system, including a bladed fan, squirrel cage fan, turbine fan, or the like.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the exemplary embodiments of the invention.

The various illustrative logical blocks, modules, and circuits described in connection with the embodiments disclosed herein, may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. The processor can be part of a computer system that also has a user interface port that communicates with a user interface, and which receives commands entered by a user, has at least one memory (e.g., hard drive or other comparable storage, and random access memory) that stores electronic information including a program that operates under control of the processor and with communication via the user interface port, and a video output that produces its output via any kind of video output format, e.g., VGA, DVI, HDMI, displayport, or any other form.

When operated on a computer, the computer may include a processor that operates to accept user commands, execute instructions and produce output based on those instructions. The processor is preferably connected to a communication bus. The communication bus may include a data channel for facilitating information transfer between storage and other peripheral components of the computer system. The communication bus further may provide a set of signals used for communication with the processor, including a data bus, address bus, and/or control bus.

The communication bus may comprise any standard or non-standard bus architecture such as, for example, bus architectures compliant with industry standard architecture ("ISA"), extended industry standard architecture ("EISA"), Micro Channel Architecture ("MCA"), peripheral component interconnect ("PCI") local bus, or any old or new standard promulgated by the Institute of Electrical and Electronics Engineers ("IEEE") including IEEE 488 general-purpose interface bus ("GPIB"), and the like.

A computer system used according to the present application preferably includes a main memory and may also include a secondary memory. The main memory provides storage of instructions and data for programs executing on the processor. The main memory is typically semiconductor-based memory such as dynamic random access memory ("DRAM") and/or static random access memory ("SRAM"). The secondary memory may optionally include a hard disk drive and/or a solid state memory and/or removable storage drive for example an external hard drive, thumb drive, a digital versatile disc ("DVD") drive, etc.

At least one possible storage medium is preferably a computer readable medium having stored thereon computer executable code (i.e., software) and/or data thereon in a non-transitory form. The computer software or data stored on the removable storage medium is read into the computer system as electrical communication signals.

The computer system may also include a communication interface. The communication interface allows' software and data to be transferred between computer system and external devices (e.g. printers), networks, or information sources. For example, computer software or executable code may be transferred to the computer to allow the computer to carry out the functions and operations described herein. The computer system can be a network-connected server with a communication interface. The communication interface may be a wired network card, or a Wireless, e.g., Wifi network card.

Software and data transferred via the communication interface are generally in the form of electrical communication signals.

Computer executable code (i.e., computer programs or software) are stored in the memory and/or received via communication interface and executed as received. The code can be compiled code or interpreted code or website code, or any other kind of code.

A "computer readable medium" can be any media used to provide computer executable code (e.g., software and computer programs and website pages), e.g., hard drive, USB drive or other. The software, when executed by the processor, preferably causes the processor to perform the inventive features and functions previously described herein.

A processor may also be implemented as a combination of computing devices, e.g., a combination of a DSP and a microprocessor, a plurality of microprocessors, one or more microprocessors in conjunction with a DSP core, or any other such configuration. These devices may also be used to select values for devices as described herein.

The steps of a method or algorithm described in connection with the embodiments disclosed herein may be embodied directly in hardware, in a software module executed by a processor, or in a combination of the two. A software module may reside in Random Access Memory (RAM), flash memory, Read Only Memory (ROM), Electrically Programmable ROM (EPROM), Electrically Erasable Programmable ROM (EEPROM), registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

In one or more exemplary embodiments, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. The memory storage can also be rotating magnetic hard disk drives, optical disk drives, or flash memory based storage drives or other such solid state, magnetic, or optical storage devices. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media. The computer readable media can be an article comprising a machine-readable non-transitory tangible medium embodying information indicative of instructions that when performed by one or more machines result in computer implemented operations comprising the actions described throughout this specification.

Operations as described herein can be carried out on or over a website. The website can be operated on a server computer, or operated locally, e.g., by being downloaded to the client computer, or operated via a server farm. The website can be accessed over a mobile phone or a PDA, or on any other client. The website can use HTML code in any form, e.g., MHTML, or XML, and via any form such as cascading style sheets ("CSS") or other.

Also, the inventors intend that only those claims which use the words "means for" are intended to be interpreted under 35 USC 112, sixth paragraph. Moreover, no limitations from the specification are intended to be read into any claims, unless those limitations are expressly included in the claims. The computers described herein may be any kind of computer, either general purpose, or some specific purpose computer such as a workstation. The programs may be written in C, or Java, Brew or any other programming language. The programs may be resident on a storage medium, e.g., magnetic or optical, e.g. the computer hard drive, a removable disk or media such as a memory stick or SD media, or other removable medium. The programs may also be run over a network, for example, with a server or other machine sending signals to the local machine, which allows the local machine to carry out the operations described herein.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A lighting device, comprising:

a lamp that emits light;

a housing, holding at least said lamp;

an electrically controllable variable fan, coupled to said housing;

a lamp controller for said lamp, which receives an electrical signal from a remote controller that is remote from said lamp, where said electrical signal includes first information to control said lamp and where said electrical signal includes second information that indicates an expected amount of ambient sound at least at one time, where said expected amount of ambient noise is based on programming in said remote controller, said lamp controller which is programmed to determine a first amount of sound in said area of said housing based on said second information, and to control said fan based on said first amount of sound in an area of said housing between a first amount of output of said fan which occurs when the first amount of sound in the area of said housing is expected to be lower, and a second amount of output of said fan, which produces more air output from said fan and more noise from said fan, which occurs when the amount of sound in the area of said housing is expected to be higher.

2. The lighting device as in claim 1, wherein said first amount of output of said fan is a lower fan speed and said second output of said fan is a higher fan speed.

3. The lighting device as in claim 1, wherein said first information commands a brightness of said lamp.

4. The lighting device as in claim 2, wherein said controller detects an overtemperature condition in the housing in which a temperature within the housing is higher than a specified amount, and automatically increases an output of said fan independent of said amount of sound received.

5. The lighting device as in claim 1, wherein said fan operates based on a digital input.

6. The lighting device as in claim 1, wherein said fan operates based on an analog input, and further comprising a D/A converter, converting an output of said controller to an analog voltage.

7. A lighting device, comprising:

a housing, holding a number of heat-producing elements, including at least a socket for a lamp, wherein when said lamp is inserted into said socket, said lamp emits light;

an electrically controllable variable fan, coupled to said housing, and operable to cool an inside of said housing;

a controller, that receives at least one electrical signal from a lamp controller that is remote from said housing, said signal being indicative of an expected amount of sound at a first time based on programming in the lamp controller, and where said at least one electrical signal also includes a control signal for said lamp to control at least one lighting parameter of said lamp, and where said controller is programmed to first detect an overtemperature condition in the housing, in which a temperature in the housing is higher than a specified amount, and where said controller operates a level of the fan at a specified cooling level independent of the expected amount of sound responsive to first detecting said overtemperature, and where said controller also programmed to second, during a time when not detecting said overtemperature condition in the housing, use said signal indicative of the expected amount of sound to control an amount of output of said fan.

8. The lighting device as in claim 7, wherein said amount of output of said fan is a lower fan speed for less expected amount of sound, and is a higher fan speed for more expected amount of sound.

9. The lighting device as in claim 8, wherein said control signal for said lamp commands sent to said controller define a brightness of said lamp.

10. The lighting device as in claim 8, wherein said fan operates based on a digital input.

11. The lighting device as in claim 8, further comprising a microphone, remote from said housing, that wirelessly transmits said signal indicative of the amount of sound in an area of said housing to said lighting device.

12. The lighting device as in claim 8, wherein said controller receives said signal indicative of the amount of sound over a controlling line that also receives commands to control operations of said lighting device.

13. The lighting device as in claim 8, wherein said fan operates based on an analog input, and further comprising a D/A converter, converting an output of said controller to an analog voltage.

14. A method, comprising:

operating a remotely controllable luminaire to produce a light output from a lamp within a housing;

using a fan for cooling an inside of said housing;

receiving a signal indicative of an expected amount of sound in an area outside of said housing that has been staged in advance, and where said signal is based on programming and not based on a measurement; and controlling said fan based on said expected amount of sound in said area between a first amount of output of said fan which occurs when the expected amount of sound is lower, and a second amount of output of said fan, which produces more air output from said fan and more noise from said fan, which occurs when the expected amount of sound in the area is higher.

15. The method as in claim 14, wherein said first amount of output of said fan is a lower fan speed and said second output of said fan is a higher fan speed.

16. The method as in claim 14, wherein said controller also receives commands sent to said controller over a link, where said commands define an operation of said lamp.

17. The method as in claim 16, wherein said commands sent to said controller define a brightness of said lamp.

* * * * *